US008813858B2

(12) United States Patent
Gatsonides et al.

(10) Patent No.: US 8,813,858 B2
(45) Date of Patent: Aug. 26, 2014

(54) INERT GAS SUPPRESSION SYSTEM FOR TEMPERATURE CONTROL

(75) Inventors: Josephine Gabrielle Gatsonides, Dunstable (GB); Robert G. Dunster, Slough (GB)

(73) Assignee: Kidde Technologies, Inc., Wilson, NC (US)

( * ) Notice: Subject to any disclaimer, the term of this patent is extended or adjusted under 35 U.S.C. 154(b) by 979 days.

(21) Appl. No.: 12/726,533

(22) Filed: Mar. 18, 2010

(65) Prior Publication Data

US 2011/0186312 A1 Aug. 4, 2011

(30) Foreign Application Priority Data

Feb. 4, 2010 (GB) ..... 1001869.5

(51) Int. Cl.
*A62C 35/00* (2006.01)

(52) U.S. Cl.
USPC ..... 169/11; 169/16; 169/62; 169/60; 169/7

(58) Field of Classification Search
USPC ..... 169/7, 46, 62, 11, 16, 60
See application file for complete search history.

(56) References Cited

U.S. PATENT DOCUMENTS

| | | | | |
|---|---|---|---|---|
| 3,592,270 | A * | 7/1971 | Livingston | 169/16 |
| 4,643,260 | A | 2/1987 | Miller | |
| 6,003,608 | A | 12/1999 | Cunningham | |
| 6,082,464 | A * | 7/2000 | Mitchell et al. | 169/43 |
| 6,173,814 | B1 | 1/2001 | Herkel et al. | |
| 6,601,653 | B2 * | 8/2003 | Grabow et al. | 169/16 |
| 6,676,081 | B2 | 1/2004 | Grabow et al. | |
| 6,899,184 | B2 | 5/2005 | Reynolds | |
| 6,935,433 | B2 * | 8/2005 | Gupta | 169/46 |
| 7,066,274 | B2 | 6/2006 | Lazzarini | |
| 7,331,401 | B2 | 2/2008 | Bobenhausen | |

(Continued)

FOREIGN PATENT DOCUMENTS

| | | |
|---|---|---|
| EP | 1 253 077 A1 | 10/2002 |
| JP | 9070445 | 3/1997 |
| WO | 93/12839 | 7/1993 |
| WO | 99/04860 A1 | 2/1999 |

OTHER PUBLICATIONS

Extended European Search Report for Application No. EP 11 25 0082 mailed May 31, 2011.

(Continued)

*Primary Examiner* — Dinh Q Nguyen
(74) *Attorney, Agent, or Firm* — Carlson, Gaskey & Olds, P.C.

(57) ABSTRACT

A fire suppression system is disclosed that includes a suppressant source system configured to hold fire suppressant. In one example, the fire suppressant is an inert gas. A temperature sensor is arranged in a suppression area and is configured to detect an undesired temperature or temperature increase in the suppression area. A suppression system is in communication with the temperature sensor and in fluid communication with the suppressant source system. The suppression system is configured to selectively release the fire suppressant to the suppression area at initial and subsequent rates. The initial rate is greater than the subsequent rate. The subsequent rate is configured to displace a volume from the suppression area through the leakage system in response to the undesired temperature.

8 Claims, 1 Drawing Sheet

(56) References Cited

U.S. PATENT DOCUMENTS

| | | | |
|---|---|---|---|
| 7,434,628 | B2 | 10/2008 | Scheidt |
| 7,510,022 | B2 | 3/2009 | Lazzarini |
| 2002/0040940 | A1 | 4/2002 | Wagner et al. |
| 2002/0070035 | A1 | 6/2002 | Grabow et al. |
| 2004/0020665 | A1 | 2/2004 | Gupta |
| 2005/0183869 | A1 | 8/2005 | Lazzarini |
| 2008/0290216 | A1 | 11/2008 | Lessi et al. |
| 2010/0236796 | A1 | 9/2010 | Chattaway et al. |

OTHER PUBLICATIONS

United Kingdom Search Report for UK Application No. GB1001869.5, May 28, 2010.
U.S. Appl. No. 12/470,817, filed May 22, 2009, "Fire Suppression System and Method".
U.S. Appl. No. 12/474,354, filed May 29, 2009, "Combined Passive and Active Vehicle Fire Prevention System".
United Kingdom Application No. 0915123.4, filed Aug. 27, 2009, "Fire Suppression System With Pressure Regulation".

* cited by examiner

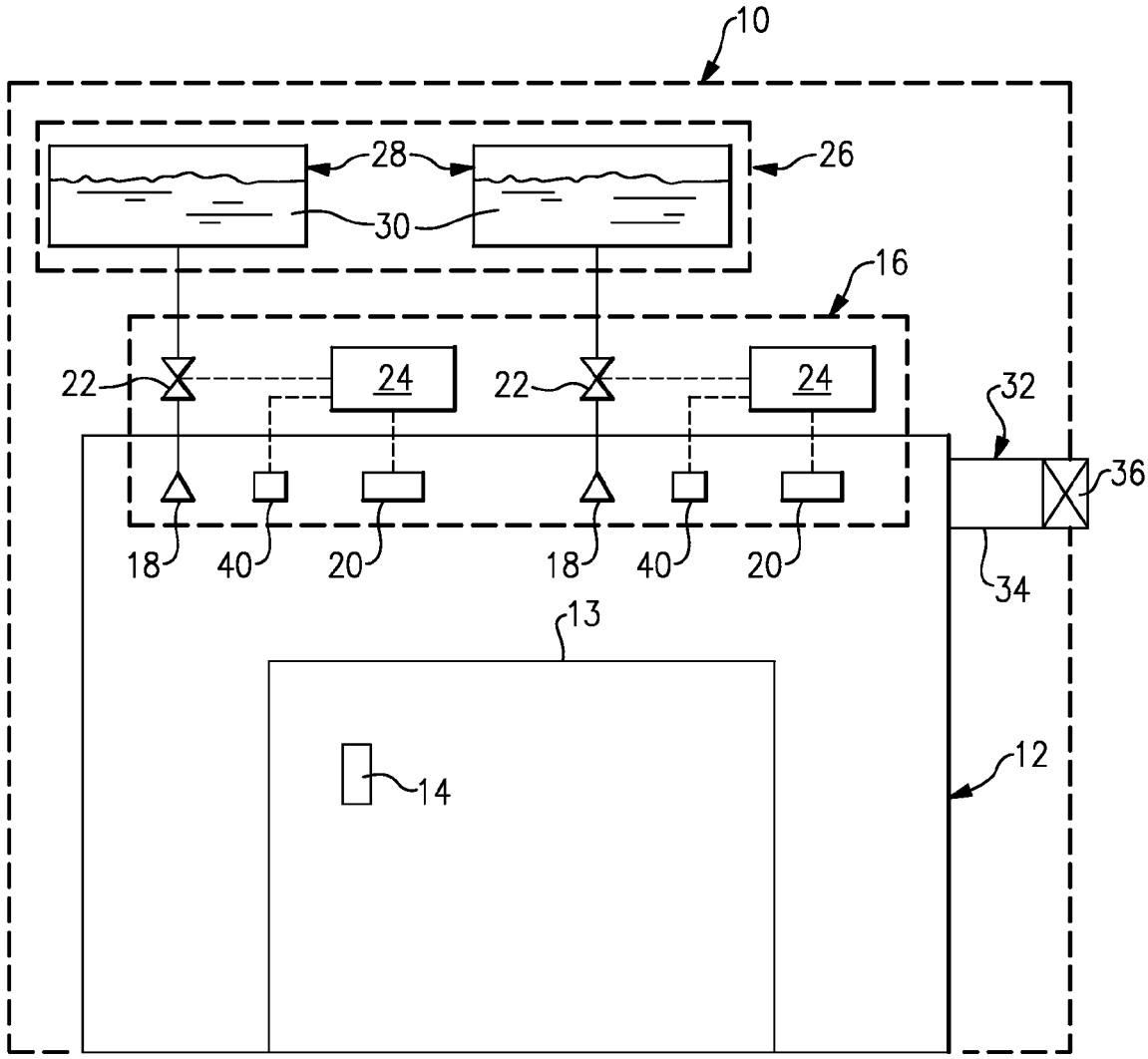
10
28
26
30
16
22
24
22
24
32
36
18
40
20
18
40
20
34
13
14
12

INERT GAS SUPPRESSION SYSTEM FOR TEMPERATURE CONTROL

This applications claims priority to United Kingdom Application No. GB1001869.5, which was filed on Feb. 4, 2010.

BACKGROUND

This disclosure relates to a fire suppression system for a suppression area that provides temperature control in the suppression area.

Fire suppression systems are used in a variety of applications, such as aircraft, buildings and military vehicles. The goal of typical fire suppression systems is to put out or suppress a fire by reducing the available oxygen in the suppression area and preventingress of fresh air that could feed the fire. One fire suppression approach has included two phases. The first phase "knocks down" the fire by supplying a gaseous fire suppressant to the suppression area at a first rate, which reduces the oxygen in the suppression area to below 12% by volume, thus extinguishing the flames. In the second phase, the gaseous fire suppressant is provided to the suppression area at a second rate, which is less than the first rate, to prevent fresh air from entering the suppression area potentially permitting a smoldering fire to reignite.

Another approach utilizes water instead of a gaseous fire suppressant to extinguish/control a fire. Water is sprayed into the suppression area for a first duration. After the initial water spray, a parameter of the suppression area is monitored, such as temperature, to detect a fire flare up. Additional sprays of water may be provided to the suppression area to prevent re-ignition of the fire.

SUMMARY

A fire suppression system is disclosed that includes a suppressant source system configured to hold fire suppressant. In one example, the fire suppressant is an inert gas. A temperature sensor is arranged in a suppression area and is configured to detect an undesired temperature or temperature increase in the suppression area. The suppression area has a leakage system through which gases may escape. A suppression system is in communication with the temperature sensor and in fluid communication with the suppressant source system. The suppression system is configured to selectively release the fire suppressant to the suppression area at initial and subsequent rates. The initial rate is greater than the subsequent rate. The subsequent rate is configured to displace a volume from the suppression area through the leakage system in response to the undesired temperature.

BRIEF DESCRIPTION OF THE DRAWINGS

The disclosure can be further understood by reference to the following detailed description when considered in connection with the accompanying drawings wherein:

FIG. 1 is a schematic view of an example fire suppression system.

DETAILED DESCRIPTION

A fire suppression system 10 is schematically shown in FIG. 1. The fire suppression system 10 includes a suppression area 12, which may be a room in a building, a cargo area of an aircraft, or a hull of a military vehicle, for example. The suppression area 12 includes a volume, which may include a space or container 13 having a fire source 14, for example. It should be understood, that the fire source 14 need not be disposed within a container 13.

An example suppression system 16 is schematically illustrated in FIG. 1. The suppression system 16 includes, for example, one or more nozzles 18, one or more detectors 20, one or more valves 22 and one or more controllers 24. In the example, the valve 22 is fluidly arranged between the nozzle 18 and a suppression source 28. The valve 22 is commanded by the controller 24 to meter the suppressant 30 from the suppression source 28 to the nozzle 18 at a desired rate. It should be understood that these components may be connected to one another in a variety of configurations and that one or more of the components may be integrated with or further separated from one another in a manner that is different than what is illustrated in FIG. 1.

A suppressant source system 26 includes one or more suppressant sources 28 that carry suppressant 30. A different suppressant may be provided in different suppressant sources, which can be selectively provided to the suppression area 12 at different times, for example. In one example, the suppressant is an inert gas, such as N2, Ar, He, Ne, Xe, Kr, or mixtures, nitrogen enriched air (NEA) (e.g., 97% by volume $N_2$) or argonite (e.g., 50% Ar and 50% $N_2$). At least one of the suppressant sources may be an on-board inert gas generation system (OBIGGS) used to supply nitrogen. The OBIGGS generated suppressant may be created using a low flow of input gas through the OBIGGS that provides a high purity of NEA, or a high flow of input gas through the OBIGGS that provides a lower purity of NEA.

A suppression area 12 typically includes a leakage system 32. The leakage system 32 permits gases, including smoke, to flow into and out of the suppression area 12 at a volumetric leakage rate. In the example of an aircraft cargo area, the leakage system 32 includes a vent 34 having a valve 36 that communicates gases from the suppression area 12 to the exterior of the aircraft. In the example of a building, the leakage system may be gaps in doors, walls and ceilings in the suppression area 12.

One or more temperature sensors 40 are arranged in the suppression area 12 to detect an undesired temperature. In one example, the undesired temperature corresponds to a temperature at which nearby composite aircraft structures begin to weaken or delaminate, e.g. 150° F.-250° F. (66° C.-121° C.).

In operation, a detector 20 detects a fire suppression event within the suppression area 12. The fire suppression event may be undesired light, heat or smoke in the suppression area 12, for example. In one example, the controller 24 includes a computer readable medium providing a computer readable program code. In one example, the computer readable program code is configured to be executed to implement a method for suppressing a fire that includes dispensing a suppressant at an initial or first rate in an amount calculated to be at least 40% by volume of a suppression area 12, and dispensing the suppressant at a subsequent or second rate that is less than the first rate.

The controller 24 commands the valve 22 to meter the suppressant 30 into the fire suppression area 12 at a first rate in response to the fire event. In one example, the first rate provides the suppressant 30, which is an inert gas, to the suppression area 12 in an amount of at least 40% by volume of the suppression area 12. For aircraft applications, the suppressant 30 is generally free of anything more than trace amounts of water. That is, a water mist is not injected into the suppression area 12 with the inert gas during the "knock down" phase of fire suppression.

In one example, the first rate delivers approximately 42% by volume of the fire suppression area. Thus, for a free air space volume of 100 $m^3$ and a sustained compartment leakage rate in fire mode of 2.5 $m^3$/minute, the initial amount of expelled hazardous hot smoke will be 42 $m^3$. Such a high flow of fire suppressant 30 reduces the oxygen concentration within the suppression area 12 to substantially less than 12% oxygen by volume, which is sufficient to control and reduce the initial temperature. Thus, a high flow of input gas through the OBIGGS that provides a lower purity of NEA is desirable. This large volume of inert gas expels a substantial amount of heat and smoke from the suppression area, for example, through the leakage system, to reduce the average temperature in the suppression area during half an hour to less than approximately 250° F. (121° C.).

In one example, the controller 24 detects the temperature within the suppression area 12 using the temperature sensors 40. If the sensed temperature reaches an undesired temperature, then the controller commands a valve 22 to release suppressant 30 to the suppression area 12, which displaces a volume from the suppression area through the leakage system 32. The displaced volume contains hot gases and smoke. The second rate at which the suppressant 30 is dispensed lowers the temperature within the suppression area 12 to a temperature below the undesired temperature.

In another example, after a predetermined time, for example, controller 24 commands a valve 22 to release a continuous flow of suppressant 30 to the suppression area 12 at a second rate that is less than the first rate. In one example, the second rate is at least approximately 40% of the volumetric leakage rate. In one example aircraft application, the leakage system 32 leaks gases out of the suppression area 12 at a rate of approximately 2.5 $m^3$/minute. Thus, for the example in which the suppressant 30 is argonite, the second rate is approximately 1.0 $m^3$/minute. In an example in which the fire suppressant 30 is nitrogen enriched air, the second rate is approximately 2.5 $m^3$/minute. The second rate is sufficient to provide an over-pressure condition within the suppression area 12, which forces gases out of the suppression area 12 through the leakage system 32. In one example, the second rate reduces the average temperature within the suppression area 12 during half an hour to less than approximately 150° F. (66° C.).

Although an example embodiment has been disclosed, a worker of ordinary skill in this art would recognize that certain modifications would come within the scope of the claims. For that reason, the following claims should be studied to determine their true scope and content.

What is claimed is:

1. A fire suppression system comprising:

a suppressant source system configured to hold fire suppressant including an inert gas;

a temperature sensor in a suppression area configured to sense an undesired temperature;

a leakage system in the suppression area having a leakage rate out of the suppression area; and a suppression system in communication with the temperature sensor and in fluid communication with the suppressant source system, the suppression system configured to selectively release the fire suppressant to the suppression area at initial and subsequent rates, the initial rate greater than the subsequent rate, the subsequent rate configured to displace a volume from the suppression area through the leakage system in response to the undesired temperature, the subsequent rate is at lease approximately 40% of the leakage rate provided by the leakage system, wherein the initial rate provides an amount of suppressant corresponding to at least approximately 40% by volume of fire suppressant to the fire suppression area, the subsequent leakage rate substantially less than the initial leakage rate and is configured to provide an over-pressure condition within the suppression area.

2. A fire suppression system according to claim 1, wherein the inert gas consists of at least 88 percent by volume of Ar, He, Ne, Xe, Kr, or mixtures thereof.

3. A fire suppression system according to claim 1, wherein the suppression system includes at least one valve and at least one controller, the controller programmed to command the at least one valve to release the fire suppressant at the initial and subsequent rates.

4. A fire suppression system according to claim 1, wherein the suppression area is a cargo area, and the leakage system includes a vent in fluid communication with the cargo area.

5. A fire suppression system according to claim 1, wherein the initial rate provides an oxygen concentration of substantially less than 12% oxygen by volume in the suppression area.

6. A fire suppression system according to claim 1, wherein the subsequent rate provides an overpressure condition in the suppression area.

7. A fire suppression system according to claim 1, wherein the undesired temperature corresponds to an average temperature in the suppression area of less than 250° F.

8. A fire suppression system according to claim 7, wherein the undesired temperature corresponds to an average temperature in the suppression area of less than 150° F.

* * * * *